US010431870B2

(12) United States Patent
Xue et al.

(10) Patent No.: US 10,431,870 B2
(45) Date of Patent: Oct. 1, 2019

(54) CHIP-AND-PACKAGE DISTRIBUTED ANTENNA

(71) Applicant: City University of Hong Kong, Kowloon (HK)

(72) Inventors: Quan Xue, Tai Po (HK); Liang Wu, Tai Wal (HK); Shaowei Liao, Fan Ling (HK)

(73) Assignee: City University of Hong Kong, Kowloon (HK)

( * ) Notice: Subject to any disclaimer, the term of this patent is extended or adjusted under 35 U.S.C. 154(b) by 27 days.

(21) Appl. No.: 15/483,827

(22) Filed: Apr. 10, 2017

(65) Prior Publication Data

US 2018/0294545 A1 Oct. 11, 2018

(51) Int. Cl.
*H01Q 13/10* (2006.01)
*H01Q 1/22* (2006.01)
(Continued)

(52) U.S. Cl.
CPC ..... *H01Q 1/2283* (2013.01); *H01Q 1/38* (2013.01); *H01Q 1/48* (2013.01); *H01Q 13/106* (2013.01); *H01Q 21/0075* (2013.01); *H01Q 21/064* (2013.01); *H01Q 1/24* (2013.01); *H01Q 5/00* (2013.01); *H01Q 11/12* (2013.01); *H01Q 13/10* (2013.01); *H01Q 21/00* (2013.01)

(58) Field of Classification Search
CPC ..... H01Q 11/12; H01Q 21/00; H01Q 5/00; H01Q 1/38; H01Q 1/24; H01Q 13/10
USPC ..... 343/770, 702, 741, 700 MS, 767, 853
See application file for complete search history.

(56) References Cited

U.S. PATENT DOCUMENTS 10,008,781 B1 * 6/2018 Pan ..... H01Q 9/0457
2003/0112184 A1 * 6/2003 Jenabi ..... H01Q 21/0025 343/700 MS
2007/0046402 A1 * 3/2007 Mukaiyama ..... H01P 3/023 333/238

(Continued)

OTHER PUBLICATIONS

Grzyb, J. et al., "A 288-GHz Lens-Integrated Balanced Triple-Push Source in a 65-nm CMOS Technology," IEEE J. Solid-State Circuits, vol. 48, No. 7, pp. 1751-1761, Jul. 2013, 11 pages.

(Continued)

*Primary Examiner* — Joseph J Lauture
(74) *Attorney, Agent, or Firm* — Norton Rose Fulbright US LLP

(57) ABSTRACT

Systems and methods which provide an antenna in a chip-and-package distributed configuration as disclosed. Chip-and-package distributed antenna configurations of embodiments comprise an on-chip integrated circuit component and an in-package component. For example, embodiments of a chip-and-package distributed antenna comprise an exciting element on chip (i.e., formed as an integrated component in an integrated circuit die) and a primary radiator in package (i.e., disposed within an package while being external to the integrated circuit die). The on-chip exciting element may be configured to excite electromagnetic waves and to provide relatively wide bandwidth operation while occupying a relatively small area of the die. The in-package primary radiator may be configured to leverage the relatively large space in the integrated circuit product package to enhance the gain and/or configure the radiation pattern of RF signals with respect to the exciting element.

34 Claims, 10 Drawing Sheets

(51) Int. Cl.

| | |
|---|---|
| ***H01Q 21/06*** | (2006.01) |
| ***H01Q 1/38*** | (2006.01) |
| ***H01Q 1/48*** | (2006.01) |
| ***H01Q 21/00*** | (2006.01) |
| *H01Q 11/12* | (2006.01) |
| *H01Q 5/00* | (2015.01) |
| *H01Q 1/24* | (2006.01) |

(56) References Cited

U.S. PATENT DOCUMENTS

2010/0207258 A1* 8/2010 Eun ..... H01L 23/055 257/660
2012/0068891 A1* 3/2012 Haroun ..... H01L 23/66 343/702
2014/0292597 A1* 10/2014 Schneider ..... H01Q 7/00 343/741

OTHER PUBLICATIONS

Han, R., "A CMOS High-Power Broadband 260-GHz Radiator Array for Spectroscopy," IEEE J. Solid-State Circuits, vol. 48, No. 12, pp. 3090-3104, Dec. 2013, 15 pages.

Jameson, S. et al., "A 300GHz Wirelessly Locked 2×3 Array Radiating 5.4dBm with 5.1% DC-to-RF Efficiency in 65nm CMOS," *IEEE Int. Solid-State Circuit Conference Dig. Tech. Papers*, Feb. 2016, 3 pages.

Han, R. et al., "A 280-GHz Schottky Diode Detector in 130-nm Digital CMOS," IEEE J. Solid-State Circuits, vol. 46, No. 11, pp. 2602-2612, Nov. 2011, 11 pages.

Tousi, Y. et al., "A High-Power and Scalable 2-D Phased Array for Terahertz CMOS Integrated Systems," *IEEE J. Solid-State Circuits*, vol. 50, pp. 597-609, Feb. 2015, 13 pages.

Zhu, H. T. et al., "A 750-1000 GHz H-Plane Dielectric Horn Based on Silicon Technology", IEEE Trans. Antennas Propag. vol. 64, No. 12, pp. 5074-5083, Dec. 2016, 10 pages.

Deng, X. D. et al., "340 GHz On-Chip 3-D Antenna with 10 dBi Gain and 80% Radiation Efficiency," IEEE Trans. THz Sci. Technol., vol. 5, No. 4, pp. 619-627, Jul. 2015, 9 pages.

Generalov, A. A. et al., "Wide Band mm- and Sub-mm-Wave Dielectric Rod Waveguide Antenna," IEEE Trans. THz Sci. Technol., vol. 4, No. 5, pp. 568-574, Sep. 2014, 7 pages.

* cited by examiner

CHIP-AND-PACKAGE DISTRIBUTED ANTENNA

TECHNICAL FIELD

The invention relates generally to antennas for radiating and receiving signals and, more particularly, to chip-and-package distributed antenna configurations.

BACKGROUND OF THE INVENTION

The use of radio frequency (RF) signals, such as for providing wireless communication of voice, images, and data, for use in imaging, to provide sensing, etc., is commonplace to the point of nearly becoming ubiquitous. Due to various reasons, such as the availability of relatively unused spectrum, radiation providing penetration of a wide variety of materials, etc., the use of RF signals at higher and higher frequencies has become of interest. For example, the terahertz (THz) band from 0.3 THz to 3 THz is gaining increasing interest due to its potential for use with respect to various applications, such as imaging, spectroscopy, and high-speed wireless communication.

An antenna is an indispensable component of any RF radiating system to radiate out the signal generated from the signal sources or transmitters and of any RF receiving system to provide a signal to the receivers or signal sink from a radiated signal impinging on the antenna. However, antenna systems can be problematic with respect to their integration with many modern circuit configurations. For example, RF radiating and receiving systems are often provided in an integrated circuit configuration, such as to provide low power implementations, small form factors, system on chip (SOC) or system in package (SIP) solutions, etc. At frequencies as high as several tens to hundreds of GHz (e.g., sub-terahertz or terahertz frequencies), physical interconnection between on-chip circuitry and an off-chip antenna is often not feasible because of the severe loss, the high packaging cost, etc. Integrating antennas with the integrated RF circuitry (e.g., including an antenna system as part of the integrated circuit) likewise generally does not provide an acceptable solution. For example, the lossy silicon substrate and the metal/dielectric structure of the integrated circuit can impose an upper limit on the antenna performance in terms of radiation efficiency, gain, and bandwidth.

Although various techniques may be utilized to address the deficiencies in antenna implementations using conventional integrated circuit configuration, the existing techniques continue to result in an antenna configuration having undesired characteristics, such as unacceptably limited bandwidth, undesirable packaging costs, etc. For example, a microstrip patch antenna may be formed in an integrated circuit die or chip with ground plate above the substrate to shield the radiation from penetrating through the lossy silicon, wherein an antenna with a length of $\lambda_g/2$ (i.e., ½ wavelength antenna, where $\lambda_g$ is the wavelength in the dielectric (here silicon)) can achieve a gain of approximately 6 dBi at 338 GHz. However, the −10 dB impedance bandwidth of this microstrip patch antenna configuration is within 5% because of the close proximity (e.g., approximately 10 μm) between the antenna element and the ground plate. As a further example, wafer thinning may be employed to reduce the substrate loss and thus to improve the radiation efficiency, although wafer thinning processes typically increase the fabrication costs dramatically. Further, a lens may be attached onto the substrate for backside radiation to increase the antenna gain. Such a lens is relatively costly and the antenna efficiency degrades as the chip area of the antenna increases. To address these issues, metal plated trenches may be implemented on the backside of the chip such that an antenna gain of approximately 3 dBi can be achieved. However, post-processing of the wafer, including backside slicing and metal filling, is required to implement the metal plated trenches, thus appreciably increasing the cost and complexity of manufacture of the circuit.

BRIEF SUMMARY OF THE INVENTION

The present invention is directed to systems and methods which provide an antenna in a chip-and-package distributed configuration. Chip-and-package distributed antenna configurations of embodiments comprise an on-chip integrated circuit component and an in-package component, thus using both the chip and package of an integrated circuit product in providing an antenna useful for radiating and/or receiving RF signals. A chip-and-package distributed antenna implemented according to the concepts of the present invention may, for example, be deployed for use with respect to systems operable with respect to millimeter-wave, sub-millimeter-wave, and/or terahertz frequencies.

Embodiments of a chip-and-package distributed antenna comprise an exciting element on chip (i.e., formed as an integrated component in an integrated circuit die) and a primary radiator in package (i.e., disposed within an package while being external to the integrated circuit die). The on-chip exciting element of embodiments of the invention is used to excite electromagnetic waves and is configured to provide relatively wide bandwidth operation while occupying a relatively small area of the die. The in-package primary radiator of embodiments of the invention is configured to leverage the relatively large space in the integrated circuit product package to enhance the gain and/or configure the radiation pattern of RF signals with respect to the exciting element.

Chip-and-package distributed antenna configurations of embodiments of the invention are configured to radiate electromagnetic (EM) waves with high gain and high efficiency at high frequencies without unacceptably increasing the cost and complexity. In particular, chip-and-package distributed antenna configurations of embodiments optimize use both chip and package of an integrated circuit product to realize high performance radiation without introducing external structures and without unacceptably increasing the cost and complexity of manufacturing the integrated circuit product.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWING

For a more complete understanding of the present invention, reference is now made to the following descriptions taken in conjunction with the accompanying drawing, in which.

DETAILED DESCRIPTION OF THE INVENTION

Figure 1:
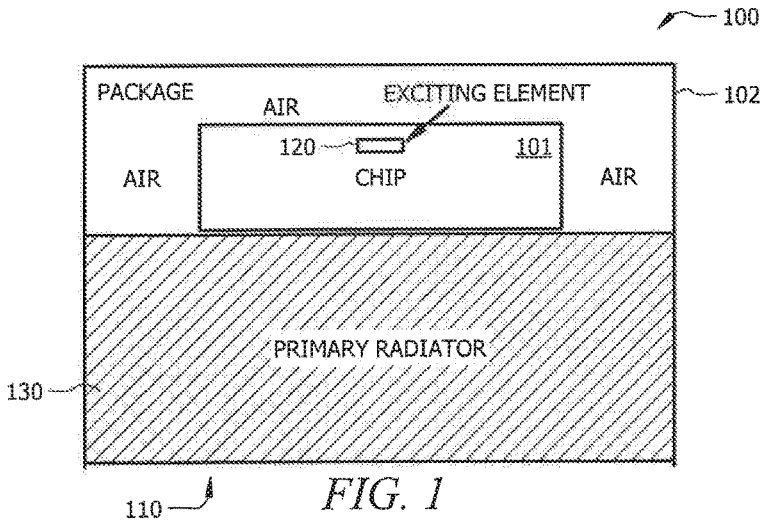
FIG. 1 shows a cross section view of an integrated circuit product configured to include a chip-and-package distributed antenna of embodiments of the present invention.

FIG. 1 shows a cross section view of integrated circuit product 100 configured according to the concepts of the present invention. Integrated circuit product 100 of the illustrated embodiment comprises chip 101 disposed in package 102. Chip 101 of embodiments comprises an integrated circuit die (e.g., dielectric substrate), such as may have various circuit components (e.g., transistors, resistors, capacitors, inductors, transmission lines, etc.) of a radiator and/or receiver system disposed therein. Package 102 of embodiments provides a protective housing in which chip 101 is disposed and through which one or more pins or other input-output interfaces may be provided. Accordingly, integrated circuit product 100 may provide a RF system module (e.g., integrated circuit component) or RF system (e.g., SOC or SIP) implementation, such as may be utilized in high speed wireless communications systems, imaging systems, spectroscopy systems, sensor systems, etc.

Integrated circuit product 100 illustrated in FIG. 1 includes an embodiment of a chip-and-package distributed antenna implemented according to the concepts of the present invention. Chip-and-package distributed antenna 110 provided with respect to the illustrated embodiment of integrated circuit product 100 comprises exciting element 120 and primary radiator 130. Exciting element 120 of embodiments herein is on-chip (i.e., formed as an integrated component in chip 101), whereas primary radiator 130 is in-package (i.e., disposed within package 102 while being external to chip 101). Accordingly, chip-and-package distributed antenna 110 of the illustrated embodiment uses both the chip and package of integrated circuit product 100 in providing an antenna implementation, such as may be useful for radiating and/or receiving RF signals.

It should be appreciated that a high-gain antenna typically implies a relatively large physical aperture size, high aperture efficiency, and high antenna efficiency. However, the physical aperture of an antenna operable at or near terahertz (THz) frequencies, wherein the wavelength is small, may be sufficiently sized such that on-chip antenna configurations can be reasonably be considered. Embodiments of chip-and-package distributed antenna 110 operable at millimeter-wave, sub-millimeter-wave, and/or terahertz frequencies comprise a configuration of exciting element 120 that, when operated with a corresponding primary radiator configuration according to concepts herein, is of a size well suited for on-chip implementation. Additionally, as discussed in further detail below, exciting element 120 of embodiments of chip-and-package distributed antenna 110 is shaped for high aperture efficiency. Exciting element 120 of embodiments may comprise various antenna element configurations, such as a slot antenna element, a microstrip antenna element, a patch antenna element, a horn antenna, etc. The exciting element of chip-and-package distributed antenna implementations preferably comprise either a unidirectional element (e.g., directed towards the primary radiator), such as patch and horn antennas, or a bidirectional element, such as dipole antenna. It should be appreciated that, although chip-and-package distributed antenna 110 as illustrated in FIG. 1 is shown with a single exciting element, embodiments of the invention may comprise a plurality of exciting elements (e.g., providing a phased array configuration, a larger effective antenna aperture, etc.).

The low antenna efficiency and low gain of on-chip antenna implementations are in large part attributable to the EM fields residing inside the lossy dielectric (e.g., silicon) substrate. Accordingly, embodiments of a chip-and-package distributed antenna herein extend the region housing the EM fields into a low-loss dielectric to reduce the power loss in the substrate and increase the antenna efficiency. For example, chip-and-package distributed antenna 110 of the illustrated embodiment comprises primary radiator 130, as may be implemented by attaching a slab of low-loss material onto chip 101, providing a low-loss dielectric in which EM fields radiated by exciting element 101 may reside. Thus, although the antenna efficiencies of an on-chip antenna implementation are typically low due to the high silicon substrate loss, chip-and-package distributed antenna 110 of the illustrated embodiment comprises primary radiator 130 operable in cooperation with exciting element 120 to facilitate large bandwidth and high gain.

The low-loss dielectric material of primary radiator 130 of embodiments of the invention is chosen to be compatible with standard packaging to facilitate its use in integrated circuit product configurations such as that of integrated circuit product 100. For example, primary radiator 130 of embodiments of chip-and-package distributed antenna 110 may comprise low-temperature co-fire ceramic (LTCC) or other suitable low-loss dielectric materials such as high-temperature co-fired ceramics (HTCC), organic high frequency laminates, etc.

In operation according to embodiments, exciting elements of a chip-and-package distributed antenna work in resonance mode and their excited power is combined within the dielectrics of the chip and primary radiator. Moreover, the low-loss dielectric material of the primary radiator of embodiments serves both as a directing dielectric to attract the excited EM waves and as a primary radiator to focus the EM energy. Accordingly, primary radiator 130 of embodiments of chip-and-package distributed antenna 110 is dimensioned such that the EM waves inside are mostly in travelling-wave mode to minimize the loss and to broaden the impedance bandwidth.

Chip-and-package distributed antenna 110 of embodiments of the invention is provided in a configuration in which the thickness of primary radiator 130 is much larger than the thickness of exciting element 120 (e.g., the primary radiator thickness is on the order of ten times greater than the exciting element thickness). In such a configuration according to preferred embodiments, the power ratio of the chip-and-package distributed antenna may be approximated as:

$$\frac{P_{air}}{P_{diel}} = \frac{1}{\varepsilon_{eff}^{3/2}} \tag{1}$$

where $P_{air}$ and $P_{diel}$ are power radiated into the air and into the dielectrics, respectively, and $\varepsilon_{eff}$ is the effective dielectric constant of the dielectrics including the silicon substrate and the primary radiator. As can be appreciated from the foregoing, the power radiated into the dielectrics is much higher than that radiated into the air. Accordingly, implementations of a chip-and-package distributed antenna configuration adopt the backside radiation through the substrate and the primary radiator as the primary antenna radiation. Therefore, the primary radiator preferably has a high relative dielectric constant such that the effective dielectric constant, $\varepsilon_{eff}$, is also relatively high to obtain good transmission between the exciting element and the primary radiator.

In the chip-and-package distributed antenna configuration of embodiments of the invention, the chip area occupied (e.g., the area occupied by exciting element 110) can be small while a relatively large space as may be made available in the package may be leveraged to host the low-loss dielectric material of the in-package primary radiator (e.g., primary radiator 130) to enhance the performance of the antenna. Compared with the previous designs with an antenna embedded only on chip, the chip-and-package distributed antenna of embodiments of the invention is much improved in gain and efficiency. Compared to prior solutions using a silicon lens to obtain high gain, chip-and-package distributed antennas of embodiments herein are considerably lower in cost and simpler in structure. For example, manufacturing and assembling of the primary radiator (e.g., comprising a slab of LTCC or similar material) is fully compatible with standard integrated circuit packaging. Moreover, in a chip-and-package distributed antenna implementation the interconnections between the die and other circuits on the outer PCB may be placed on the package, similar to and consistent with traditional packages operable at the lower frequency bands.

Additionally, the chip-and-package distributed antenna configuration of embodiments can be readily scaled up/down. For example, scaling of a chip-and-package distributed antenna may be provided by adjusting the primary radiator design in accordance with the size of on-chip exciting elements.

Having generally described chip-and-package distributed antenna configurations in accordance with concepts of the present invention, exemplary embodiments of chip-and-package distributed antennas are provided below to aid in understanding the concepts herein. In particular, two exemplary embodiments operable at 320 GHz are described, wherein the first exemplary embodiment comprises a convex shape implementing a 1-port input and achieves maximum gain of 7 dBi and bandwidth of 10%, while the second exemplary embodiment comprises a cube shape implementing a 4-port input and achieves maximum gain of 5 dBi and bandwidth of 13%.

Figure 2A:
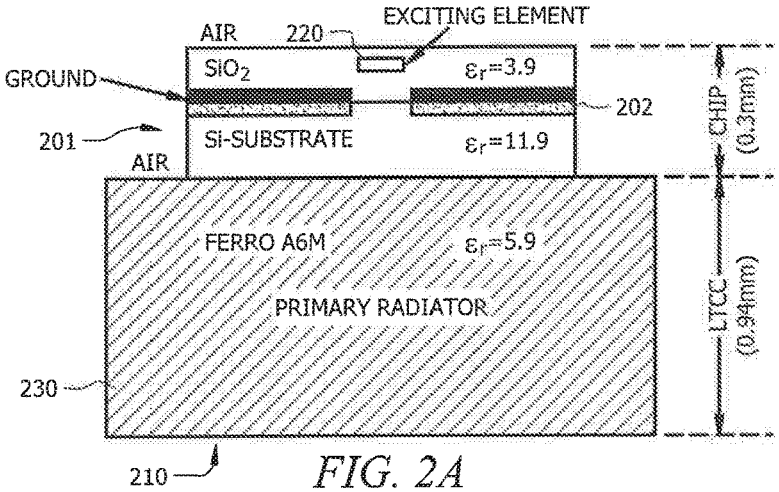
FIGS. 2A and 2B show an exemplary embodiment of a 1-port input chip-and-package distributed antenna configuration of embodiments of the present invention.
Figure 2B:
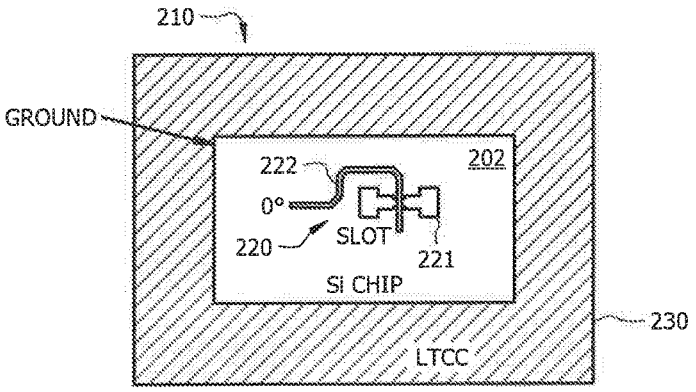

FIGS. 2A and 2B show an exemplary embodiment of a chip-and-package distributed antenna configuration implementing a 1-port input. In particular, FIG. 2A shows a cross section view and FIG. 2B shows a top plan view of chip-and-package distributed antenna 210 configured according to concepts of the present invention. It should be appreciated that, although chip-and-package distributed antenna 210 may be provided as part of an integrated circuit product comprising chip 201, various components of such an integrated circuit product (e.g., an integrated circuit package to provide a protective housing in which the chip and associated chip-and-package distributed antenna are disposed, pins or other input-output interfaces, etc.) for simplicity.

As can be seen from the detail shown in FIGS. 2A and 2B, exciting element 220 of the exemplary embodiment comprises a slot antenna configuration. Such a slot antenna configuration for exciting element 220 is preferred for EM wave excitation to achieve wideband operation for chip-and-package distributed antenna 210. In implementing the slot antenna configuration of exciting element 220 of the exemplary embodiment, a 65-nm bulk CMOS process featuring 1 poly and 9 metal layers may be used, wherein a parallel combination of two bottom metal layers (e.g., M1 and M2) may be used for ground plane 202 where slots 221 are formed and the top thickest metal layer (e.g., M9) may be used for feedline 222 of exciting element 220 to minimize the resistivity. It should be appreciated from the illustrated embodiment that, unlike regular rectangle slot shapes, slots 221 provided with respect to the exemplary slot antenna configuration of exciting element 220 are tapered to maximize the bandwidth. In particular, slots 221 of the exemplary embodiment are tapered such that the width of the slot is changed segmentally. For example, steps may be used in the taper of slots 221 in order to be compatible with the CMOS fabrication technology. To facilitate wide bandwidth operation, the length and width of slots 221 of embodiments are preferably larger than $\lambda_g/2$ and $\lambda_g/4$, respectively.

Figure 2C:
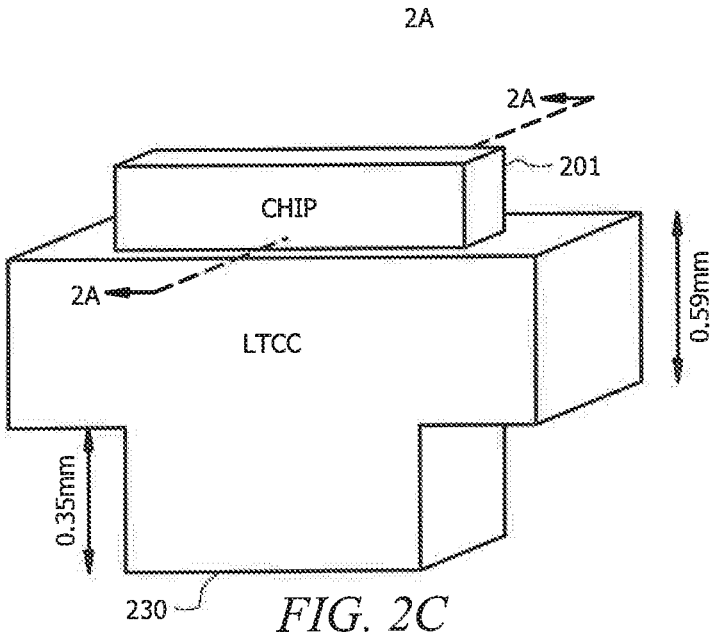
FIGS. 2C and 2D show detail with respect to the configuration of the primary radiator the 1-port input chip-and-package distributed antenna of FIGS. 2A and 2B according to embodiments of the present invention.
Figure 2D:
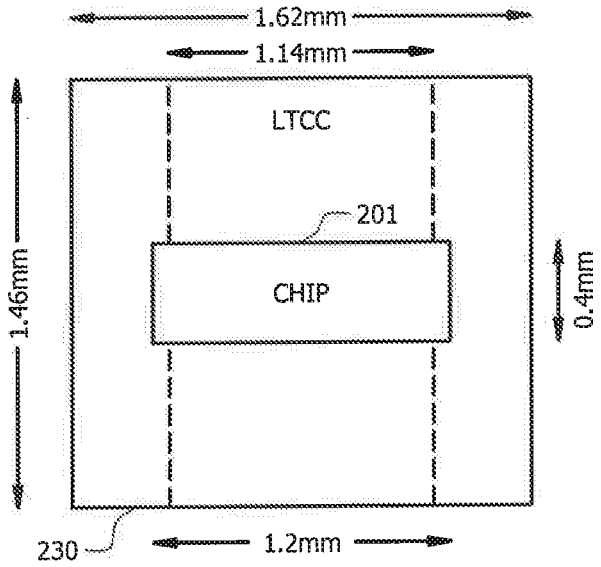

FIGS. 2C and 2D show detail with respect to the configuration of primary radiator 230 of the exemplary embodiment of chip-and-package distributed antenna 210. Primary radiator 210 may, for example, be comprised of a slab of LTCC material (e.g., FERRO A6M) disposed on the back of chip 201. The low loss LTCC material of primary radiator 210 of the exemplary embodiment provides a dielectric constant $\in_r$ of 5.9. The dimensions of chip 201 and primary radiator 230 of the exemplary embodiment of chip-and-package distributed antenna 210 are shown in the illustrations of FIGS. 2C and 2D. It can be appreciated from the illustrations of FIGS. 2C and 2D that primary radiator 230 of the exemplar embodiment includes areas in which material is removed from the LTCC slab to provide a convex shape for chip-and-package distributed antenna 210. Such a convex shape implementation of the primary radiator imitates, to some extent, a lens and may be used to facilitate focusing EM energy and thus improve the gain. Additionally or alternatively, one or more metal patterns may be placed on in the primary reflector to improve or further improve focus and the antenna performance.

Figure 3:
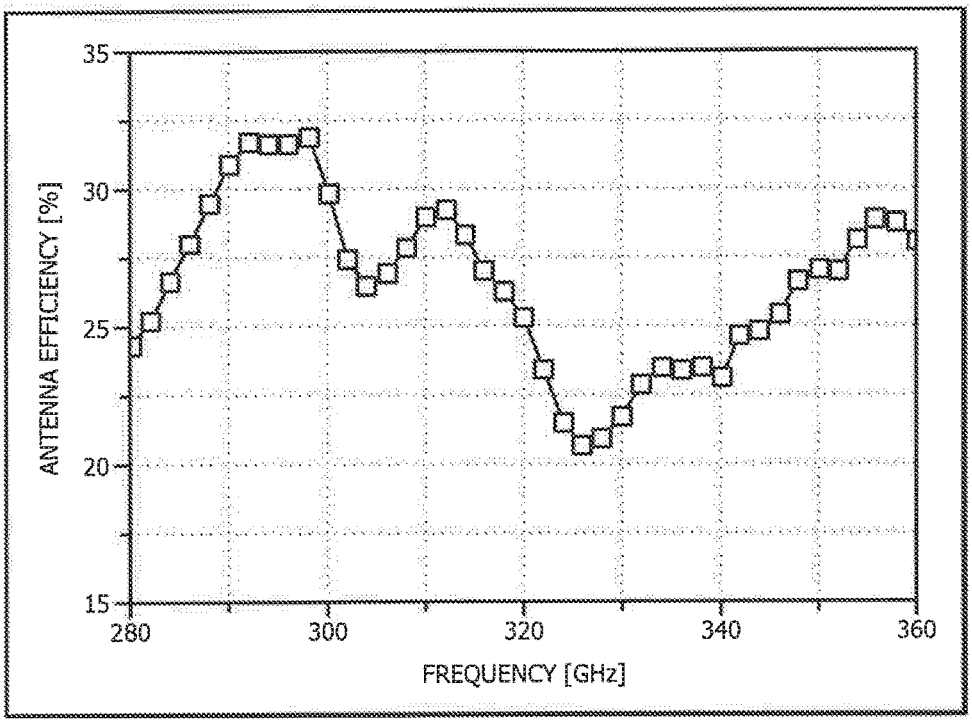
FIG. 3 shows a graph of simulation results with respect to antenna efficiency of the 1-port input chip-and-package distributed antenna of FIGS. 2A and 2B according to embodiments of the present invention.
Figure 4:
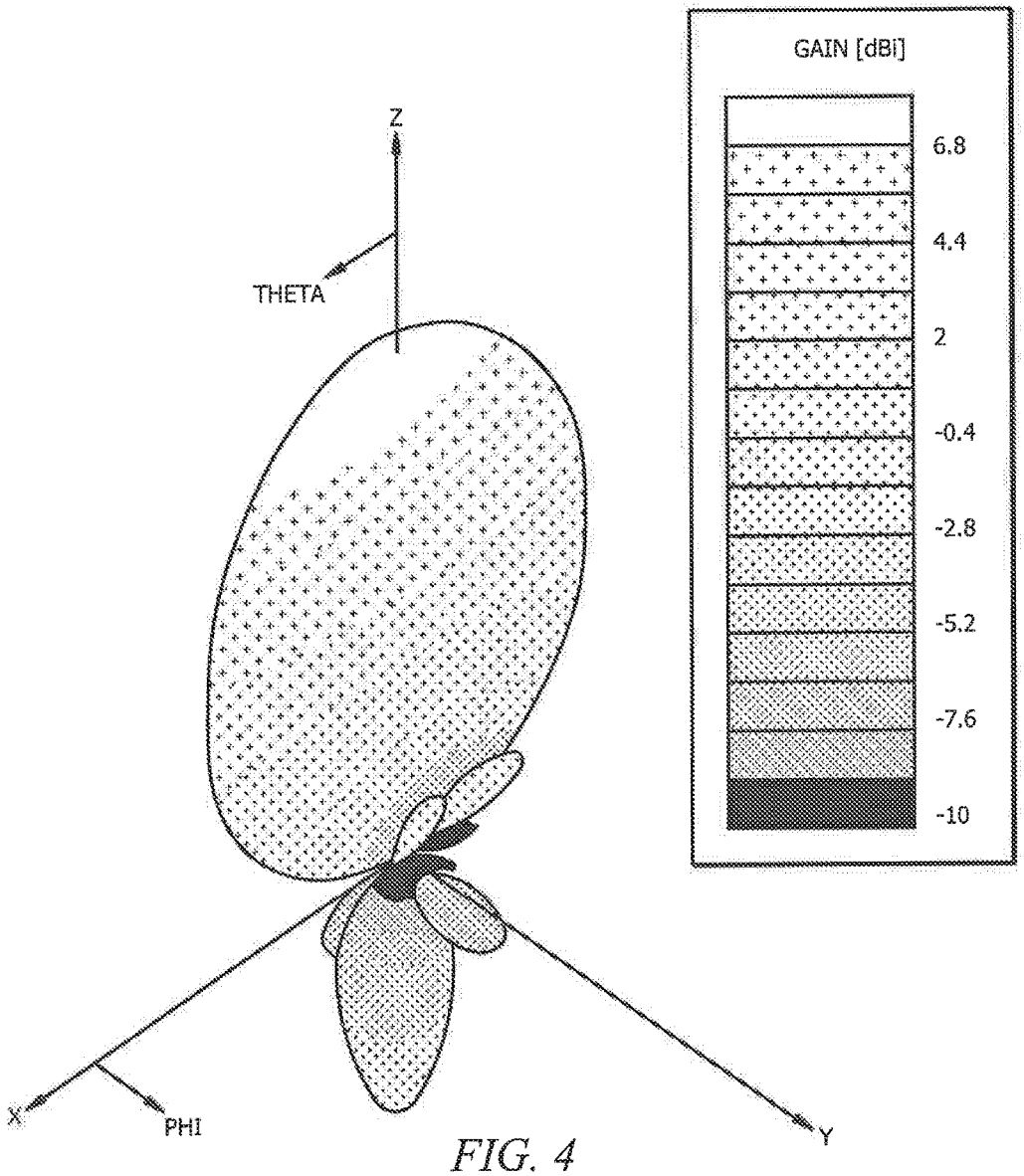
FIG. 4 shows a radiation pattern from simulation results of the 1-port input chip-and-package distributed antenna of FIGS. 2A and 2B according to embodiments of the present invention.
Figure 5:
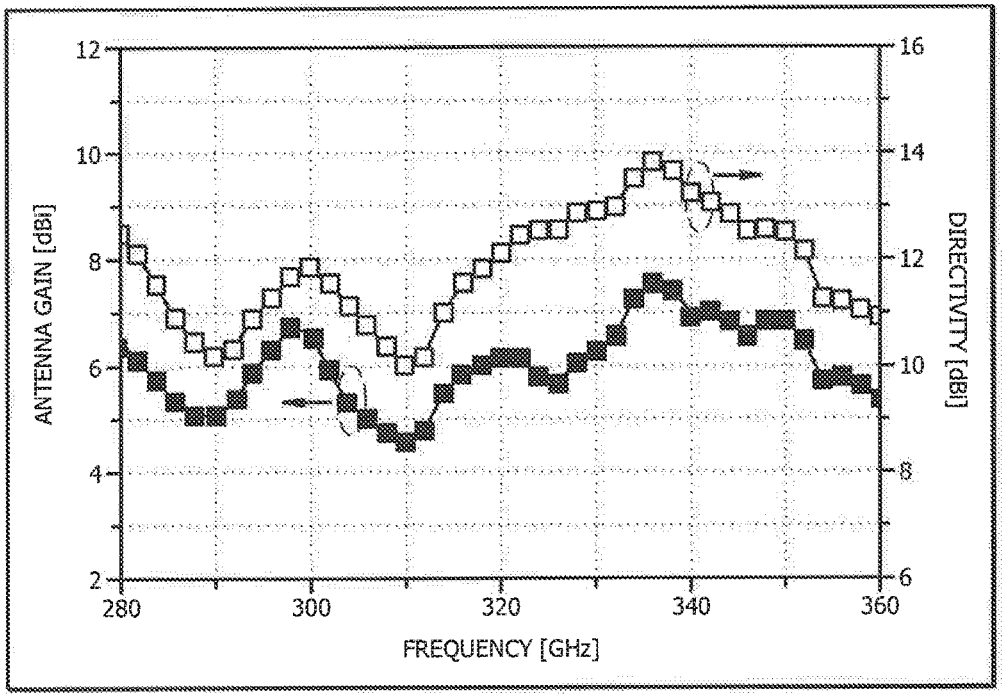
FIG. 5 shows a graph of simulation results with respect to antenna gain and directivity of the 1-port input chip-and-package distributed antenna of FIGS. 2A and 2B according to embodiments of the present invention.

High frequency structural simulator (HFSS) simulations performed with respect to the above described exemplary configuration of chip-and-package distributed antenna 210 show that the chip-and-package distributed antenna configuration provides appreciable improvement over the operation of previous designs with an antenna embedded only on chip. In particular, the graph of simulation results with respect to antenna efficiency shown in FIG. 3 indicate that the antenna efficiency is 21-32% for a frequency range from 280 to 360 GHz. The simulated radiation pattern for the above described exemplary configuration of chip-and-package distributed antenna 210 operating at 320 GHz is shown in FIG. 4. As may be appreciated from the graph of FIG. 4, the bidirectional beam of the exciting element (slot antenna) becomes unidirectional by placing the primary radiator on it and the main beam is along the positive direction (towards the primary radiator). The graph of simulation results with respect to antenna gain and directivity shown in FIG. 5 indicates that the realized gain and the directivity of the distributed antenna are 4.6-7.5 dBi and 10-13.8 dBi for the frequency from 280 to 360 GHz, respectively.

Figure 6A:
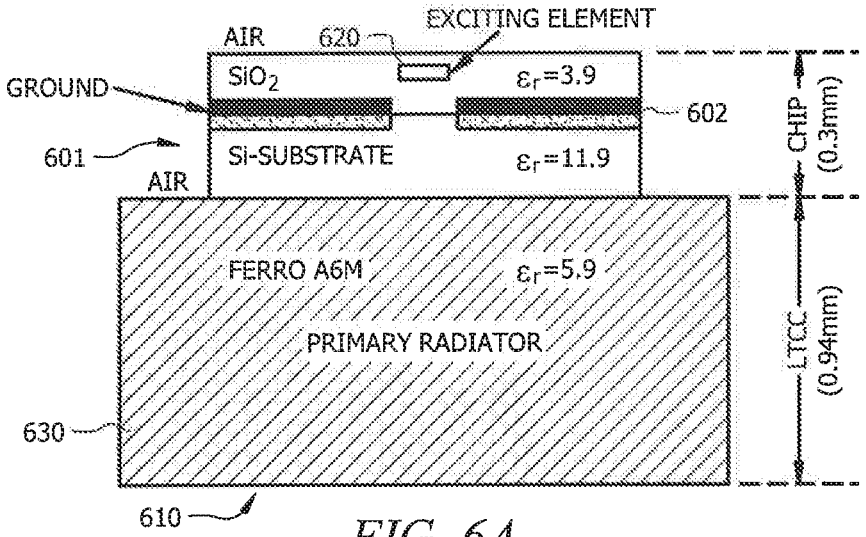
FIGS. 6A and 6B show an exemplary embodiment of a 4-port input chip-and-package distributed antenna configuration of embodiments of the present invention.
Figure 6B:
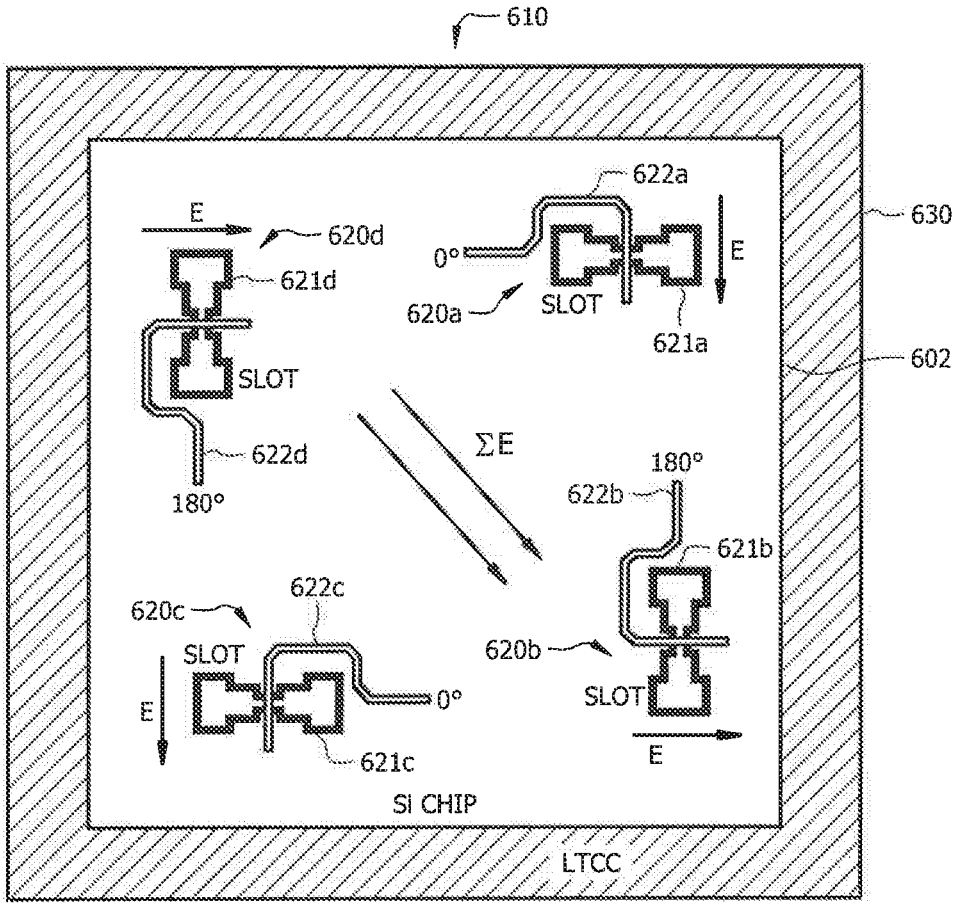

FIGS. 6A and 6B show an exemplary embodiment of a chip-and-package distributed antenna configuration implementing a 4-port input. In particular, FIG. 6A shows a cross section view and FIG. 6B shows a top plan view of chip-and-package distributed antenna 610 configured according to concepts of the present invention. It should be appreciated that, although chip-and-package distributed antenna 610 may be provided as part of an integrated circuit product comprising chip 601, various components of such an integrated circuit product (e.g., an integrated circuit package to provide a protective housing in which the chip and associated chip-and-package distributed antenna are disposed, pins or other input-output interfaces, etc.) for simplicity.

As can be seen from the detail shown in FIG. 6B, chip-and-package distributed antenna 610 of the exemplary embodiment comprises a multiple exciting element configuration including exciting elements 620*a*-620*d*. Such a multiple exciting element configuration facilitates power combining for enhancing the output power of chip-and-package distributed antenna 610 at high frequencies.

Similar to exciting element 220 of the exemplary embodiment of chip-and-package distributed antenna 210 discussed above, the illustrated embodiment of chip-and-package distributed antenna 610 comprises slot antenna configuration implementations of exciting elements 620*a*-630*d*. In implementing the slot antenna configuration of exciting elements 620*a*-620*d* of the exemplary embodiment, a 65-nm bulk CMOS process featuring 1 poly and 9 metal layers may be used, wherein a parallel combination of two bottom metal layers (e.g., M1 and M2) may be used for ground plane 602 where slots 621*a*-621*d* are formed and the top thickest metal layer (e.g., M9) may be used for feedlines 622*a*-622*d* of exciting elements 620*a*-620*d* to minimize the resistivity. As with the previously described exemplary embodiment, slots 621*a*-621*d* provided with respect to the exemplary slot antenna configuration of exciting elements 620*a*-620*d* are tapered to maximize the bandwidth. Additionally, slots 621*a*-621*d* and associated feedlines 622*a*-622*d* of exciting elements 620*a*-620*d* are each oriented in correspondence to the different phase of the driving signals. For instance, if the phase interval for the driving signals is 180°, then the feedlines and exciting elements may be oriented in a corresponding 180° rotational symmetry, as shown in FIG. 6B, so that the radiated power is constructively combined and the polarization of the antenna array is along a diagonal direction. As another example, if the phase interval for the driving signals is 90°, then the feedlines and exciting elements may be oriented in a corresponding 90° rotational symmetry.

Figure 6C:
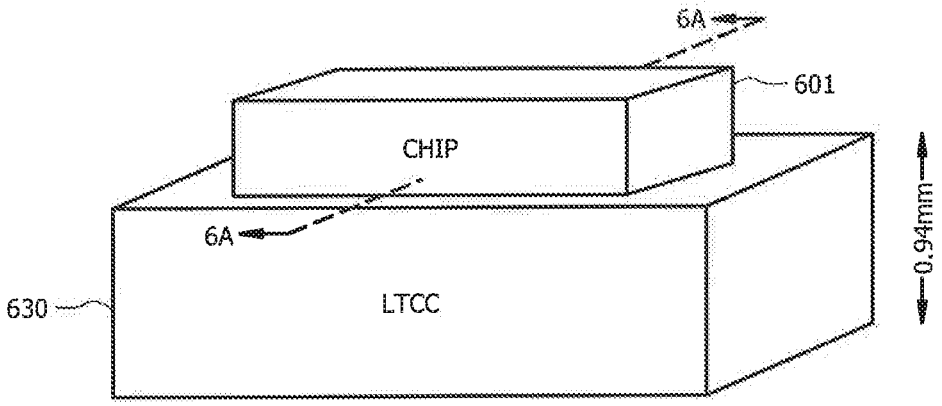
FIGS. 6C and 6D show detail with respect to the configuration of the primary radiator the 4-port input chip-and-package distributed antenna of FIGS. 6A and 6B according to embodiments of the present invention.
Figure 6D:
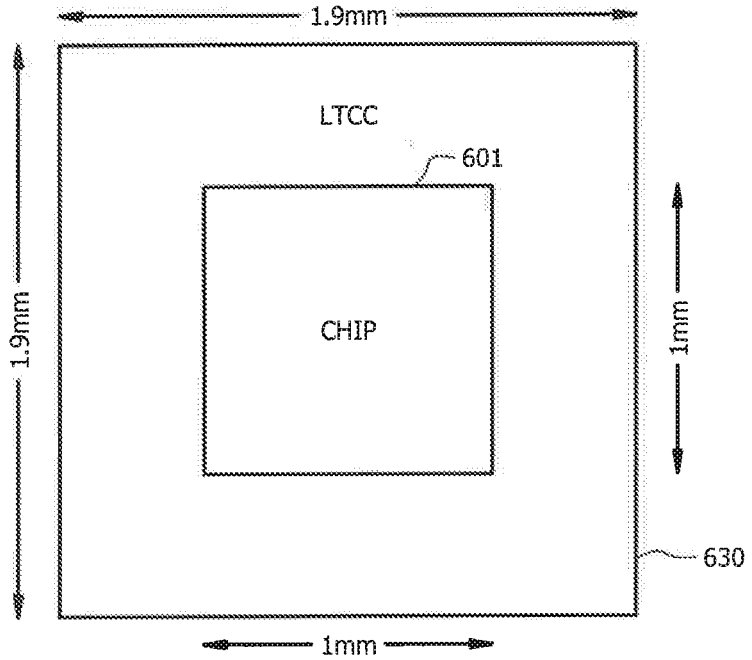

FIGS. 6C and 6D show detail with respect to the configuration of primary radiator 630 of the exemplary embodiment of chip-and-package distributed antenna 610. Primary radiator 610 may, for example, be comprised of a slab of LTCC material (e.g., FERRO A6M) disposed on the back of chip 601. The low loss LTCC material of primary radiator 610 of the exemplary embodiment provides a dielectric constant $\in_r$ of 5.9. The dimensions of chip 601 and primary radiator 630 of the exemplary embodiment of chip-and-package distributed antenna 610 are shown in the illustrations of FIGS. 6C and 6D. It can be appreciated from the illustrations of FIGS. 6C and 6D that primary radiator 630 of the exemplar embodiment is comprised of material formed as a rectangle or cuboid shape. Although a primary radiator implementation adopting a convex shape (e.g., FIG. 2C) may provide some performance advantage, a cuboid primary radiator implementation (e.g., FIG. 6C) may nevertheless be desirable in some embodiments. For example, the available LTCC fabrication processes may impose restrictions with respect to the ability to physically or practically implement a primary radiator having a convex shape. The cuboid shape for the primary radiator of the exemplary example, however, is readily implemented using LTCC fabrication processes and thus may be preferred in some embodiments, despite degraded performance as compared to a convex primary radiator configuration.

Figure 7:
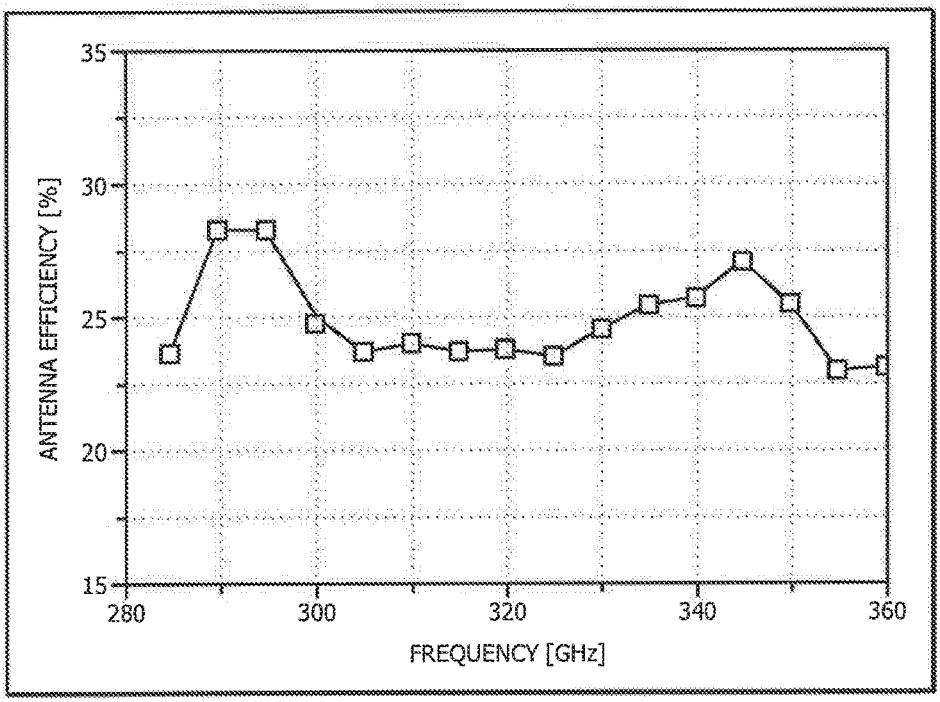
FIG. 7 shows a graph of simulation results with respect to antenna efficiency of the 4-port input chip-and-package distributed antenna of FIGS. 6A and 6B according to embodiments of the present invention.
Figure 8:
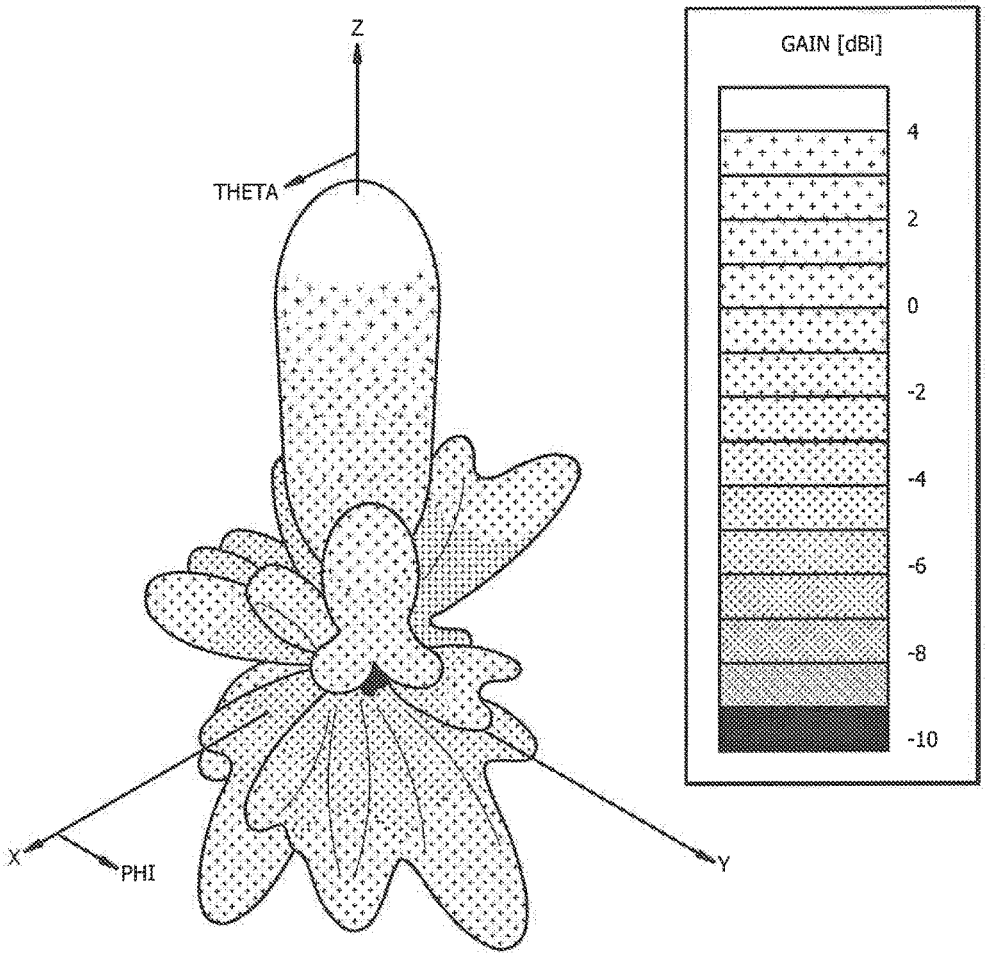
FIG. 8 shows a radiation pattern from simulation results of the 4-port input chip-and-package distributed antenna of FIGS. 6A and 6B according to embodiments of the present invention.
Figure 9:
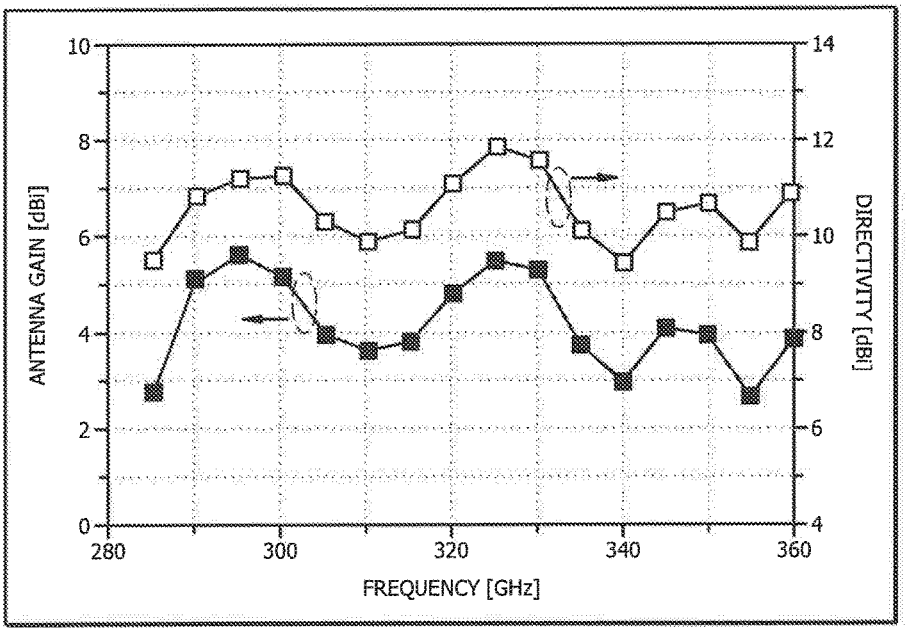
FIG. 9 shows a graph of simulation results with respect to antenna gain and directivity of the 4-port input chip-and-package distributed antenna of FIGS. 6A and 6B according to embodiments of the present invention.

HFSS simulations performed with respect to the above described exemplary configuration of chip-and-package distributed antenna 610 show that the chip-and-package distributed antenna configuration provides appreciable improvement over the operation of previous designs with an antenna embedded only on chip. In particular, the graph of simulation results with respect to antenna efficiency shown in FIG. 7 indicate that the efficiency is 23.5-28% for a frequency range from 290 to 350 GHz. The simulated radiation pattern for the above described exemplary configuration of chip-and-package distributed antenna 610 operating at 320 GHz is shown in FIG. 8. As can be appreciated from the graph of FIG. 8, the exemplary configuration of chip-and-package distributed antenna 610 provides a very good unidirectional pencil beam, which indicates the good radiation performance of the antenna. The graph of simulation results with respect to antenna gain and directivity shown in FIG. 9 indicates that the realized gain and the directivity of the distributed antenna are 3.0-5.5 dBi and 9.4-11.9 dBi for the frequency from 290 to 350 GHz, respectively.

Although the exemplary embodiments have been described above with respect to particular configurations, it should be appreciated that the concepts herein are applicable to a wide variety of chip-and-package distributed antenna configurations. For example, numbers of exciting elements and/or primary radiators different than those of the exemplary embodiments may be utilized. Embodiments may, for example, utilize two exciting elements disposed in an appropriate rotational symmetry according to embodiments. Further, embodiments may utilize multiple primary radiators, such as to provide a separate primary radiator with respect to each exciting element or groups of exciting elements.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A chip-and-package distributed antenna comprising:

one or more exciting elements integrated in an integrated circuit chip of an integrated circuit product, wherein the integrated circuit product comprises the integrated circuit chip and a package housing the integrated circuit chip; and a primary radiator disposed in the package and external to the integrated circuit chip, wherein the primary radiator is configured to operate in cooperation with the one or more exciting elements to radiate, receive, or radiate and receive electromagnetic (EM) waves of radio frequency (RF) signals.

2. The chip-and-package distributed antenna of claim 1, wherein the primary radiator is attached to either a backside or a frontside of the integrated circuit chip.

3. The chip-and-package distributed antenna of claim 1, wherein the primary radiator comprises a low-temperature co-fire ceramic (LTCC) material.

4. The chip-and-package distributed antenna of claim 1, wherein the one or more exciting elements comprise a slot-antenna element configuration.

5. The chip-and-package distributed antenna of claim 4, wherein a slot of the slot-antenna element configuration is tapered.

6. The chip-and-package distributed antenna of claim 5, wherein the tapered slot comprises a slot taper in which a width of the slot is changed segmentally.

7. The chip-and-package distributed antenna of claim 1, wherein the one or more exciting elements are a single exciting element.

8. The chip-and-package distributed antenna of claim 1, wherein the one or more exciting elements comprise:

a plurality of exciting elements configured to provide power combining for enhancing an output power of the chip-and-package distributed antenna.

9. The chip-and-package distributed antenna of claim 8, wherein the plurality of exciting elements are four exciting elements.

10. The chip-and-package distributed antenna of claim 8, wherein exciting elements of the plurality of exciting elements are disposed in different orientations configured to accommodate different phases of driving signals.

11. The chip-and-package distributed antenna of claim 10, wherein the different orientations of the exciting elements of the plurality of exciting elements comprise a rotational symmetry corresponding to driving signals having 90° phase intervals.

12. The chip-and-package distributed antenna of claim 10, wherein the different orientations of the exciting elements of the plurality of exciting elements comprise a rotational symmetry corresponding to driving signals having 180° phase intervals.

13. The chip-and-package distributed antenna of claim 1, wherein the primary radiator comprises material formed as a cuboid shape.

14. The chip-and-package distributed antenna of claim 1, wherein the primary radiator comprises material formed as a convex shape.

15. A method for providing a chip-and-package distributed antenna, the method comprising:

integrating one or more exciting elements in an integrated circuit chip for including in an integrated circuit product, wherein the integrated circuit product comprises the integrated circuit chip and a package housing the integrated circuit chip; and attaching a primary radiator to a surface of the integrated circuit chip, wherein the primary radiator is configured to be disposed in the package and external to the integrated circuit chip, wherein the primary radiator is configured to operate in cooperation with the one or more exciting elements to radiate, receive, or radiate and receive electromagnetic (EM) waves of radio frequency (RF) signals.

16. The method of claim 15, wherein the surface of the integrated circuit chip is either a backside or a frontside of the integrated circuit chip.

17. The method of claim 15, wherein the primary radiator comprises a low-temperature co-fire ceramic (LTCC) material.

18. The method of claim 15, wherein the one or more exciting elements comprise a slot-antenna element configuration.

19. The method of claim 18, wherein a slot of the slot-antenna element configuration is tapered.

20. The method of claim 19, wherein the tapered slot comprises a slot taper in which a width of the slot is changed segmentally.

21. The method of claim 15, wherein the integrating the one or more exciting elements in an integrated circuit chip comprises:

integrating a single exciting element in the integrated circuit chip.

22. The method of claim 15, wherein the integrating the one or more exciting elements in an integrated circuit chip comprises:

integrating a plurality of exciting elements in the integrated circuit chip, wherein the plurality of exciting elements are configured to provide power combining for enhancing an output power of the chip-and-package distributed antenna.

23. The method of claim 22, wherein the integrating the one or more exciting elements in an integrated circuit chip comprises:

orienting exciting elements of the plurality of exciting elements in different orientations configured to accommodate different phases of driving signals.

24. The method of claim 23, wherein the different orientations of the exciting elements of the plurality of exciting elements comprise a rotational symmetry corresponding to driving signals having 90° phase intervals.

25. The method of claim 23, wherein the different orientations of the exciting elements of the plurality of exciting elements comprise a rotational symmetry corresponding to driving signals having 180° phase intervals.

26. The method of claim 15, further comprising:

forming the primary radiator as a cuboid shape.

27. The method of claim 15, further comprising:

forming the primary radiator as a convex shape.

28. The method of claim 15, further comprising:

disposing the primary radiator and the integrated circuit chip including the one or more exciting elements in a package to form an integrated circuit product.

29. A system comprising:

an integrated circuit package configured to house one or more integrated circuit chip;

an integrated circuit chip disposed in the integrated circuit package and having one or more integrated exciting elements; and a primary radiator disposed in the integrated circuit package and attached to a backside of the integrated circuit chip, wherein the primary radiator and the one or more integrated exciting elements are configured to form a chip-and-package distributed antenna.

30. The system of claim 29, wherein the primary radiator comprises a low-temperature co-fire ceramic (LTCC) material.

31. The system of claim 29, wherein the one or more integrated exciting elements comprise a slot-antenna element configuration having a tapered slot.

32. The system of claim 29, wherein the one or more integrated exciting elements comprise:

a plurality of exciting elements configured to provide power combining for enhancing an output power of the chip-and-package distributed antenna, wherein exciting elements of the plurality of exciting elements are disposed in different orientations configured to accommodate different phases of driving signals.

33. The system of claim 29, wherein the primary radiator comprises material formed as a cuboid shape.

34. The system of claim 29, wherein the primary radiator comprises material formed as a convex shape.

* * * * *